US007194216B2

(12) United States Patent
Borton et al.

(10) Patent No.: US 7,194,216 B2
(45) Date of Patent: Mar. 20, 2007

(54) METHOD AND APPARATUS FOR MEASURING TONER CONCENTRATION

(75) Inventors: Michael D. Borton, Ontario, NY (US); R. Enrique Viturro, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 240 days.

(21) Appl. No.: 10/904,609

(22) Filed: Nov. 18, 2004

(65) Prior Publication Data

US 2006/0104654 A1 May 18, 2006

(51) Int. Cl.
*G03G 15/00* (2006.01)

(52) U.S. Cl. ..... 399/74

(58) Field of Classification Search ..... 399/9, 399/24, 27, 29, 30, 58, 61, 62, 64, 74
See application file for complete search history.

(56) References Cited

U.S. PATENT DOCUMENTS 3,870,197 A * 3/1975 Landrith ..... 222/52
4,155,652 A * 5/1979 Buchan et al. ..... 399/64
5,860,041 A 1/1999 Tanaka et al.
6,115,561 A * 9/2000 Fukushima ..... 399/49
6,289,184 B1 9/2001 Yoo et al.
6,370,342 B1 4/2002 Masumura
6,377,760 B1 4/2002 Hagiwara
6,496,662 B1 12/2002 Buchanan et al.
6,571,071 B2 5/2003 Kanoshima et al.
6,606,463 B2 8/2003 Gross et al.
6,687,477 B2 2/2004 Ichida et al.
2003/0228157 A1 12/2003 Byun et al.

FOREIGN PATENT DOCUMENTS

JP 02-058071 A 2/1990

* cited by examiner

*Primary Examiner*—Hoan Tran
(74) *Attorney, Agent, or Firm*—Oliff & Berridge PLC

(57) ABSTRACT

A device to measure toner concentration can include a selector that selects a type of developer material to be measured and a sensor that detects an amount of light reflected off a developer material. A controller within the device can determine a value corresponding to a toner concentration of the developer material based on the amount of light detected by the sensor.

15 Claims, 5 Drawing Sheets

METHOD AND APPARATUS FOR MEASURING TONER CONCENTRATION

BACKGROUND

The present disclosure is directed to printing systems, and in particular to method and apparatus for measuring toner concentration in a developer material.

In a typical electrophotographic printing process, an electrostatic latent image on a photoconductive member corresponding to an original document is developed by bringing a developer material into contact with the photoconductive member. Generally, the developer material includes toners adhering triboelectrically to carrier granules. The toners are attracted from the carrier granules to the latent image forming a toner image on the photoconductive member. The toner image is then transferred from the photoconductive member to a copy sheet. The toners are then heated to permanently affix the toner image to the copy sheet.

U.S. Pat. No. 6,449,441 to Koji Masuda discloses a supplying device for supplying toner and carrier to a developer container in conformity with an output of a detector where an intensity of an electric field for shifting the carrier from the developer bearing member to an image bearing member is greater than an intensity of an electric field formed between a nonimage portion of the electrostatic latent image formed on the image bearing member and the developer bearing member.

U.S. Patent Publication No. 2003/0228157 to Seung-Young Byun et al. discloses a method of detecting toner depletion in an image forming apparatus that includes comparing an accumulation pixel number Qt that is obtained by accumulating and counting a number of pixels of a printed image with a reference pixel number Qr calculated from an amount of toner received in a developing unit, and recognizing that the image forming apparatus is in a toner low state if the accumulation pixel number Qt is larger than the reference pixel number Qr.

U.S. Pat. No. 6,687,477 to Motoharu Ichida et al. discloses a toner recycling control system that stably feeds a liquid developer of an appropriate concentration to a liquid developing apparatus employing a high-viscosity liquid developer, appropriately adjusts the concentration of residual developer collected after development and after transfer, and feeds the adjusted developer to the developing apparatus.

U.S. Pat. No. 6,606,463 to Eric M. Gross et al. discloses a toner maintenance system for an electrophotographic developer unit that includes a sump for storing a quantity of developer material including toner material, a first member for transporting developer material from sump, a viewing window in communication with toner material in the sump, an optical sensor for measuring reflected light off the viewing window and toner material, and generating a signal indicative thereof.

U.S. Pat. No. 6,571,071 to Yuichiro Kanoshima et al. discloses an integration density acquiring unit for a consumption information management apparatus that acquires integration density from an image signal sent from an image processing section, and an information converting unit that calculates a quantity of consumer toner by multiplying the integration density by a specified coefficient to send the quantity to a cumulative consumption information calculating unit.

U.S. Pat. No. 6,496,662 to John Andrew Buchanan discloses a toner chamber having a transparent window at its bottom, and a reflective surface also at the bottom. An optical emitter and receiver periodically senses for returned light, which indicates toner low.

U.S. Pat. No. 6,377,760 to Yoshihiro Hagiwara discloses a toner concentration measuring apparatus that measures a concentration of a toner in a developer and having a first and second light guiding devices whose end surfaces project into a duct traversed by developer fluid, and a light receiving device for receiving light transmitted from the first light guiding device to the second light guiding device.

U.S. Pat. No. 6,370,342 to Tomohiro Masumura discloses a toner concentration sensor that has a pair of optical members for optically coupling a light emitting device and a photodetector. The optical members are disposed with a gap therebetween for introducing liquid developer to measure transparency of the liquid developer and to evaluate the toner concentration.

U.S. Pat. No. 6,289,184 to Yong-Baek Yoo et al. discloses a developer film forming device for forming a developer film and a sensing device including a light source unit for emitting colored light corresponding to a range of wavelengths for which light transmissivity is relatively low to a developer film of a selected color developer, and a photodetector for receiving the light emitted by the light source unit and transmitted through the developer film. Thus, a thin developer film is formed and the concentration of developer is measured by emitting light in the range of wavelengths.

SUMMARY

It is desirable to regulate the addition of toners to the developer material in order to ultimately control the triboelectric characteristics (tribo) of the developer material. However, control of the triboelectric characteristics of the developer material are generally considered to be a function of the toner concentration within the developer material. Therefore, for practical purposes, attempts are usually made to control the concentration of toners in the developer material.

Toner tribo is an important parameter for development and transfer of toners. Constant toner tribo would be an ideal case. Unfortunately, toner tribo varies with time and environmental changes. Since toner tribo is almost inversely proportional to toner concentration (TC), the toner tribo variation can be compensated by controlling the toner concentration.

Toner concentration is usually measured by a toner concentration (TC) sensor. However, during a normal course of operation, certain operating conditions, for example, low area coverage and other conditions can cause toners to reside in the developer housing for a long period of time. This may cause the TC sensor to report erroneous TC readings. Therefore, in order to bring the electrophotographic printing system into normal operation, known procedures involve taking samples from the developer housing and taking it to a laboratory for analysis. This procedure is often repeated for optimal performance and is time consuming.

Thus, a device to measure toner concentration according to an exemplary embodiment can include a selector that selects a type of developer material to be measured and a sensor that detects an amount of light reflected off a developer material. A controller within the device determines a value corresponding to a toner concentration of the developer material based on the amount of light detected by the sensor. In various embodiments, the device is portable. In various embodiments, the device includes a light source that emits light at the developer material. Preferably, the light source is diffused light.

Methods according an embodiment includes accepting a user input for a type of developer material, detecting an amount of light reflected off a developer material, and determining a value corresponding to a toner concentration of the developer material based on the amount of light detected.

These and other features and advantages are described in, or are apparent from, the following detailed description of various exemplary embodiments of the methods and apparatus.

BRIEF DESCRIPTION OF THE DRAWINGS

Various exemplary embodiments will be described in detail with references to the following figures, wherein.

DETAILED DESCRIPTION OF PREFERRED EMBODIMENTS

Figure 1:
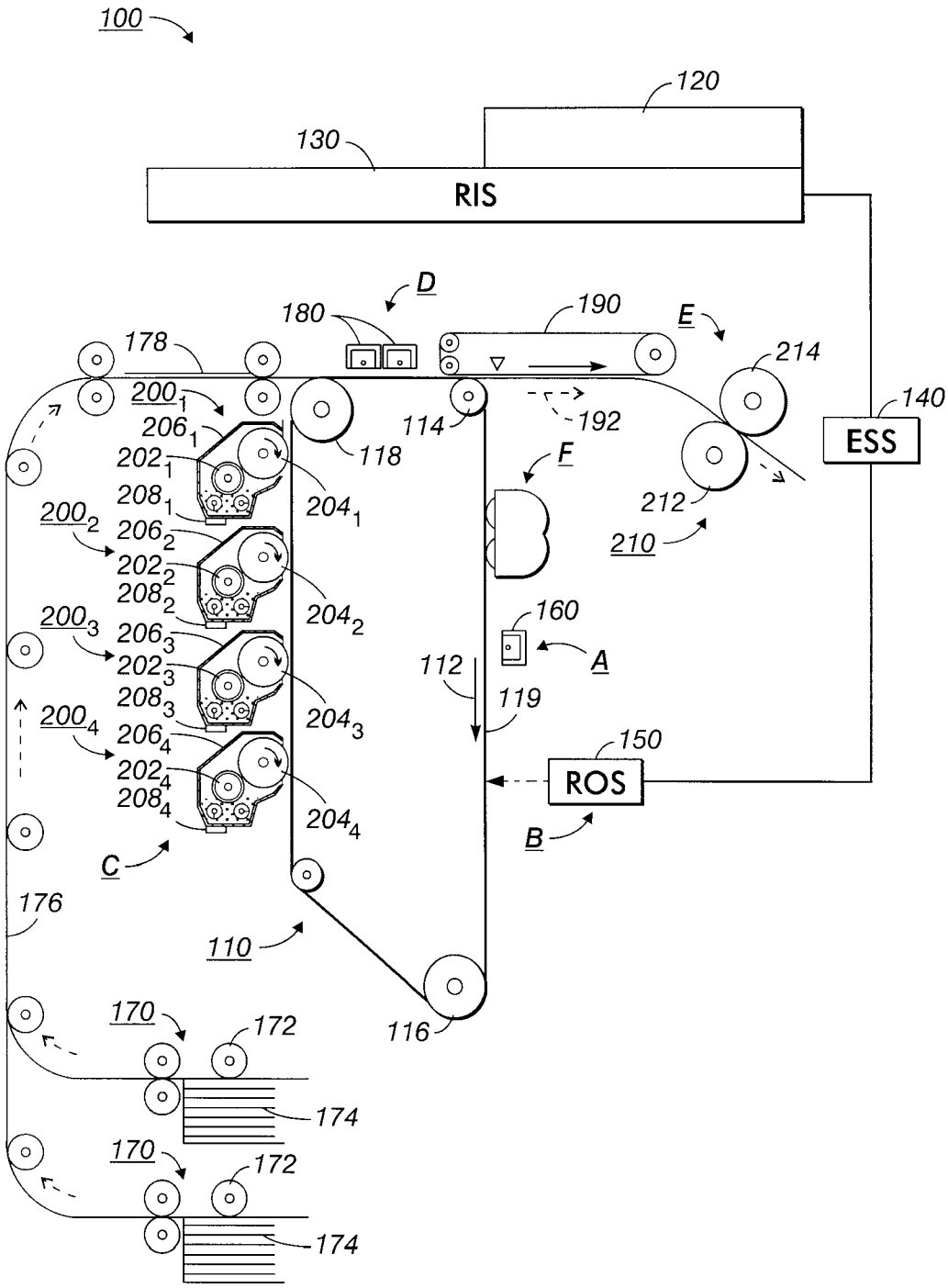
FIG. 1 illustrates a functional diagram of an exemplary electrophotographic printing system.

FIG. 1 illustrates an exemplary electrophotographic printing system that generally employs a photoconductive belt 110. An original document can be positioned in a document handler 120 on a raster input scanner (RIS) 130. The RIS 130 contains document illumination lamps, optics, a mechanical scanning drive and a charge coupled device (CCD) array. The RIS 130 captures the original document and converts it to a series of raster scan lines. This information is transmitted to an electronic subsystem (ESS) 140 which controls a raster output scanner (ROS) 150.

The photoconductive belt 110 moves in the direction of arrow 112 to advance successive portions of the belt sequentially through the various processing stations A–F disposed about its path of movement. The photoconductive belt 110 is entrained about stripping roller 114, tensioning roller 116 and drive roller 118. As the drive roller 118 rotates, it advances the photoconductive belt 110 in the direction of arrow 112.

Initially, a portion of the photoconductive surface passes through charging station A. At charging station A, a corona generating device 160 charges the photoconductive belt 110 to a relatively high, substantially uniform potential.

Then, at exposure station B, the ESS 140 receives the image signals representing the desired output image and processes these signals to convert them to a continuous tone or grayscale rendition of the image which is transmitted to the raster output scanner (ROS) 150. The ROS 150 may include a laser with rotating polygon mirror. The ROS 150 illuminates the charged portion of photoconductive belt 110, and thereby cause the photoconductive belt 110 to record an electrostatic latent image thereon corresponding to the continuous tone image received from ESS 140. As an alternative, ROS 150 may employ a linear array of light emitting diodes (LEDs) arranged to illuminate the charged portion of photoconductive belt 110 on a raster-by-raster basis.

After the electrostatic latent image has been recorded on photoconductive surface 119, the photoconductive belt 110 advances the latent image to development station C, where toners, in the form of liquid or dry particles, are electrostatically attracted to the latent image using commonly known techniques. The latent image attracts toners from the carrier granules forming a toner image thereon. As successive electrostatic latent images are developed, toners are depleted from the developer material.

After the electrostatic latent image is developed, the toner image present on photoconductive belt 110 advances to transfer station D. A print sheet from a sheet stack 174 is advanced to the transfer station D, by a sheet feeding apparatus 170. The sheet feeding apparatus 170 includes a feed roll 172 contacting the uppermost sheet of the sheet stack 174. Feed roll 172 rotates to advance the uppermost sheet from the sheet stack 174 into vertical transport 176. The vertical transport 176 directs the advancing sheet into a registration transport 178 and past image transfer station D to receive an image from photoconductive belt 110 in a timed sequence so that the toner image formed thereon contacts the advancing sheet at transfer station D. The transfer station D may include a corona generating device 180 which sprays ions onto the back side of the sheet. This attracts the toner image from photoconductive surface 119 to the sheet. After transfer, the sheet continues to move in the direction of arrow 192 by way of belt transport 190 which advances the sheet to fusing station E.

The fusing station E can include a fuser assembly 210 which permanently affixes the transferred toner image to the sheet. The fuser assembly 210 includes a heated fuser roller 212 and a pressure roller 214 with the toner image on the sheet contacting fuser roller 212.

After the print sheet is separated from photoconductive surface 119 of photoconductive belt 110, the residual toner/developer and paper fiber particles adhering to photoconductive surface 119 are removed at cleaning station F. The cleaning station F includes a rotatably mounted fibrous brush in contact with photoconductive surface 119 to disturb and remove paper fibers and a cleaning blade to remove the nontransferred toners. The blade may be configured in either a wiper or doctor position depending on the application. Subsequent to cleaning, a discharge lamp (not shown) floods photoconductive surface 119 with light to dissipate any residual electrostatic charge remaining thereon prior to the charging thereof for the next successive imaging cycle.

Referring back to station C, four developer dispensers $\mathbf{200}_{1\text{-}4}$ may be included in the printing system 100 and may be positioned parallel to one another and aligned vertically with a prescribed interval between neighboring dispensers $\mathbf{200}_{1\text{-}4}$. For example, the developer dispenser $\mathbf{200}_1$ may be a yellow developer dispenser dispensing a yellow toner, the developer dispenser $\mathbf{200}_2$ may be a magenta developer dispenser dispensing a magenta toner, the developer dispenser $\mathbf{200}_3$ may be a cyan developer dispenser dispensing a cyan toner, and the developer dispenser $\mathbf{200}_4$ may be a black developer dispenser dispensing a black toner.

Each of the developer dispensers $\mathbf{200}_{1\text{-}4}$ may include a developing roller $\mathbf{204}_{1\text{-}4}$, a supply roller $\mathbf{202}_{1\text{-}4}$, and a toner accommodating developer housing $\mathbf{206}_{1\text{-}4}$. Each of the toner developer housings $\mathbf{206}_{1\text{-}4}$ is filled with their respective toners yellow, magenta, cyan, and black. A connecting/separating mechanism (not shown) is provided to horizontally move a corresponding developer dispenser $\mathbf{200}_{1\text{-}4}$ to bring the developing roller $\mathbf{204}_{1\text{-}4}$ into and out of contact with the surface of the photoconductive belt 110. Toner dispensers (not shown), on signal from the ESS 140, dispenses toners into their respective developer housings $206_{1-4}$ of the developer dispensers $200_{1-4}$ based on signals from toner concentration sensors $208_{1-4}$.

It is desirable to regulate the addition of toners to the developer material in order to ultimately control the triboelectric characteristics (tribo) of the developer material. This is due to the fact that toner tribo is an important parameter for development and transfer of toners to a sheet. Constant toner tribo would be an ideal case. Unfortunately, toner tribo varies with time and environmental changes. Control of the triboelectric characteristics of the developer material are generally considered to be a function of the toner concentration within the developer material. Therefore, for practical purposes, attempts are usually made to control the concentration of toners in the developer material. Since toner tribo is almost inversely proportional to toner concentration (TC), the toner tribo variation can be compensated by controlling the toner concentration.

Toner concentration is measured by a toner concentration (TC) sensor. However, during normal course of operation, various operating conditions may cause the TC sensor to report erroneous TC readings. For example, TC sensors $208_{1-4}$ embedded in the develop housings $206_{1-4}$ tend to drift with time and developer material state. The ability to measure actual TC values at the printing system site would allow for quick recalibration of the TC sensors $208_{1-4}$ and reduce the printing system down time.

Figure 2:
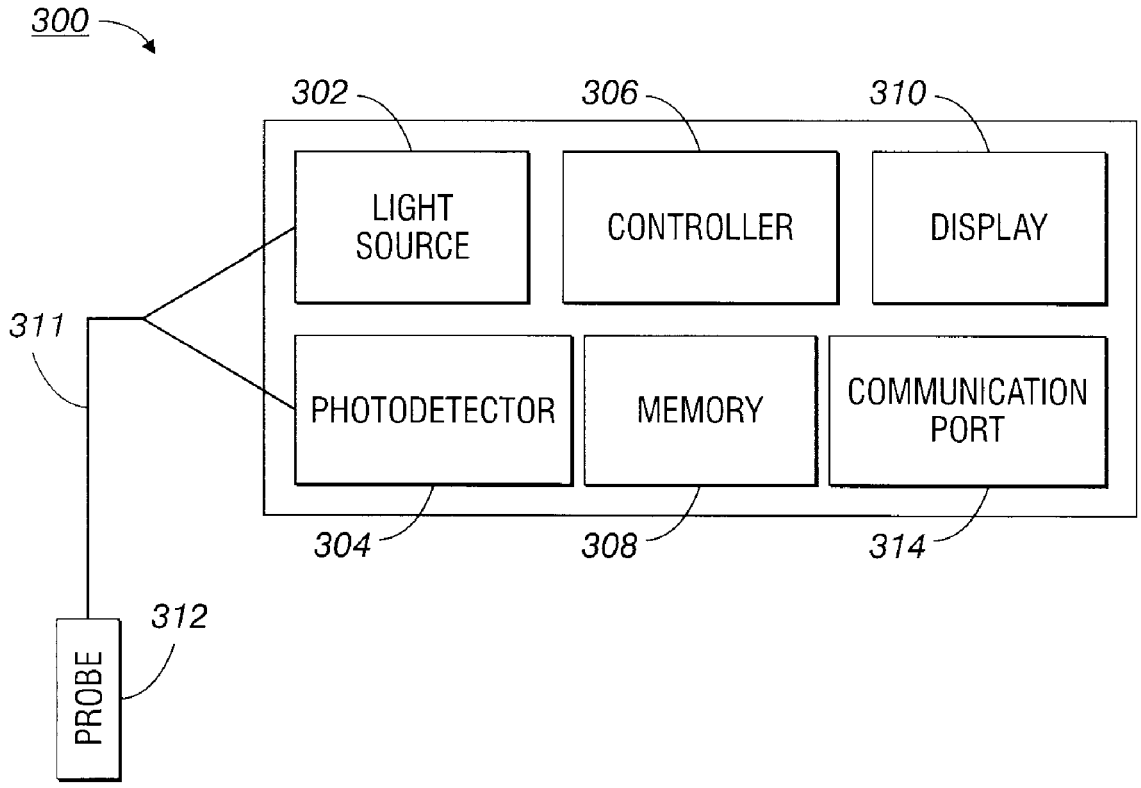
FIG. 2 illustrates an exemplary optical toner concentration (OTC) device.

FIG. 2 is an exemplary optical toner concentration (OTC) device 300. The OTC device 300 can be portable, easy to carry, and provides for TC measurements at the printing system site. In various embodiments, the OTC device 300 can include a battery as a power source. Alternatively, a power line can be provided to connect the OTC device 300 to a power source.

Although various light sources can be used, it is preferred that the OTC device 300 utilize diffuse light and diffuse light reflectance from the developer material to infer toner concentration (TC). The OTC device 300 includes a light source 302, a photodetector 304, a controller 306, a memory 308, a display 310 and a probe 312. The OTC device 300 can be further provided with an optional communication port 314 that allows the OTC device 300 to communication with a computer or a network. Using the communication port 314, the OTC device 300 may communicate with the computer or network for data logging, calibration information, trouble shooting, upgrades and the like. The controller 306 controls the overall operation of the OTC device 300. The light source 302 can be a light emitting diode (LED) that emits light selected from the visible or non-visible spectrum. According to one embodiment, the LED emits infrared radiation at a wavelength of about 940 nm. The light travels along a fiber optic bundle 311 to a probe head 312 which may be inserted through a port of a toner developer housing. Alternatively, a sample of the developer material may be taken out of the developer housing and the probe head 312 is inserted into the sample. The probe head 312 emits the light on the developer material and receives the reflected light from the developer material. The reflected light then transmits through the optic fiber bundle 311 to the OTC device 300.

Within the OTC device 300, the photodetector 304 detects the reflected light. According to one embodiment, the photodetector 304 can be a silicon photodiode. The amount of light detected by the photodetector 304 is a function of toner concentration (TC). The amount of light detected by the photodetector 304 can be used as an index to a lookup table stored in the memory 308, which will output a value that is used by the display 310 to display a reading corresponding to a percent toner concentration (TC) detected in the developer material. Preferably, the memory 308 is a non-volatile memory such as a Flash memory. Further details of the lookup table will be discussed referencing FIGS. 4 and 5.

Figure 3:
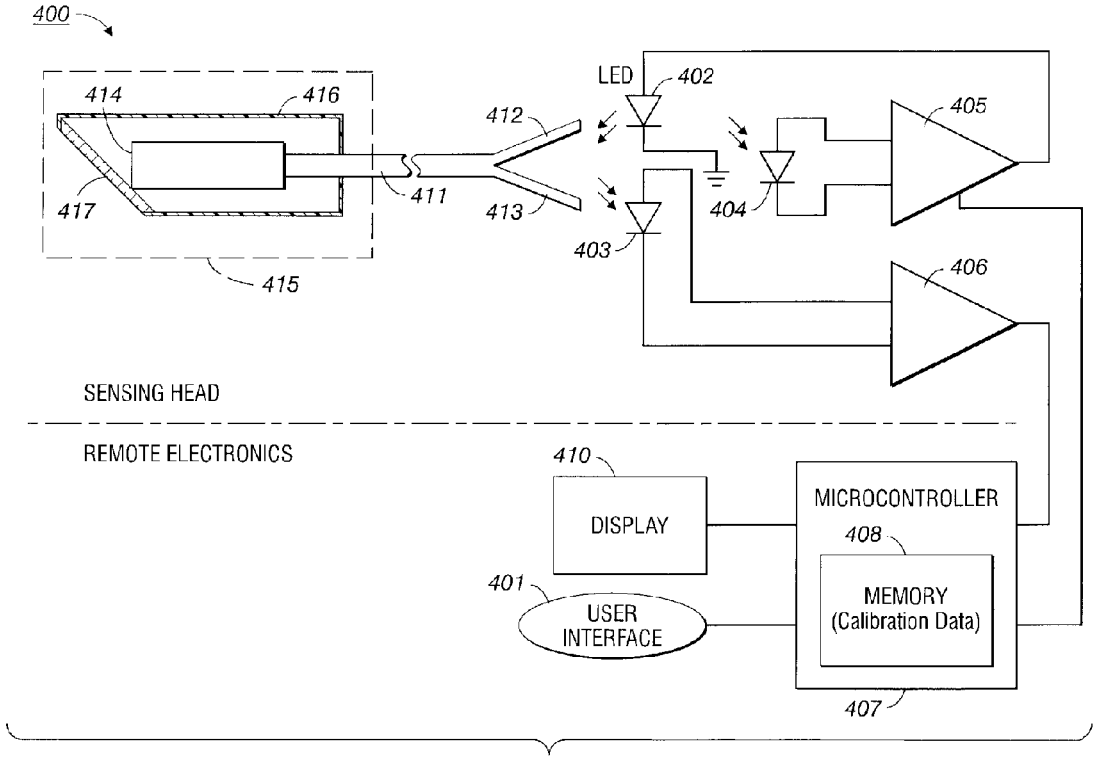
FIG. 3 illustrates another exemplary OTC device.

FIG. 3 is another exemplary OTC device 400 in accordance with an exemplary embodiment. The OTC device 400 includes a light emitting diode 402 that emits diffuse light into a fiber optic bundle assembly 411. The fiber optic bundle assembly 411 includes emitter fibers 412 and detector fibers 413 that are randomized so that the emitter fibers 412 and detector fibers 413 are uniformly distributed throughout the proximal (common) end 414 of the bundle assembly 411. The common end 414 is protected from the developer material by an enclosure 416 fitted with a window 417 which can include the probe 415. The window 417 can be made of glass, plastic or a transparent material. According to one embodiment, the window is oriented at substantially 45 degrees to the fiber optic bundle assembly 411. This configuration aids in minimizing the specular (mirror-like) reflections back into the fiber optic bundle assembly 411, that is, any specular light from the window 417, either from the inner or outer surfaces, will be directed back towards the enclosure 416. The inner surface of the enclosure 416 is configured to be minimally reflective, and thereby absorbing the specular reflections.

The diffused light emitted from the emitter fibers 412 of the fiber optic bundle assembly 411 is directed to a developer material in which the toner concentration is to be measured. The diffused light reflected from the developer material is received by the detector fibers of the fiber optic bundle assembly 411 and transmitted to a photodiode 403. The photodiode 403 converts the received light into electrical signals having a magnitude that is proportional to the amount of light received by the photodiode 403. The electrical signals are received as input to an amplifier 406 that amplifies the electrical signals to a magnitude compatible with the microcontroller 407 operation parameters. The microcontroller 407 uses the received electrical signals as an index to the memory 408 to retrieve a corresponding percent TC which is displayed at the display 408.

The gain and offset of the electrical signals may vary depending on whether black or color developer materials are being measured. For instance, the reflectance of the black toner is usually lower than that of the colored toners. The base carrier without the toners usually has a brownish color and has nominal reflectance. Colored developer materials, which may be a mixture of the base carrier and colored toners (e.g., cyan, magenta, yellow, red, blue, and etc.) reflect light better than the mixture of the base carrier and black toner. This is because the black toner absorbs light and causes the reflected light from the developer mixture to decrease.

It is desirable that similar readings be obtained for the various color developer materials and black developer material so that the user need not memorize or use a "cheat sheet" to correlate various readings with various developer materials measured. For instance, the gain and offset parameters may be adjusted by the OTC device so that the optical toner concentration (OTC) count falls within the range of 350–500 counts/percent TC. In various instances, the gain for black developer material can be made roughly 8 times that of color developer materials to make the gain comparable to color developer materials. For color developer materials, however, a 50% offset may be subtracted to achieve a greater sensitivity over the 2% to 8% nominal sensing range. Gains and offsets may be varied by adjusting the amount of current sent to the LED 402 and/or by varying the feedback voltage to the amplifiers 405 and 406.

Figure 4:
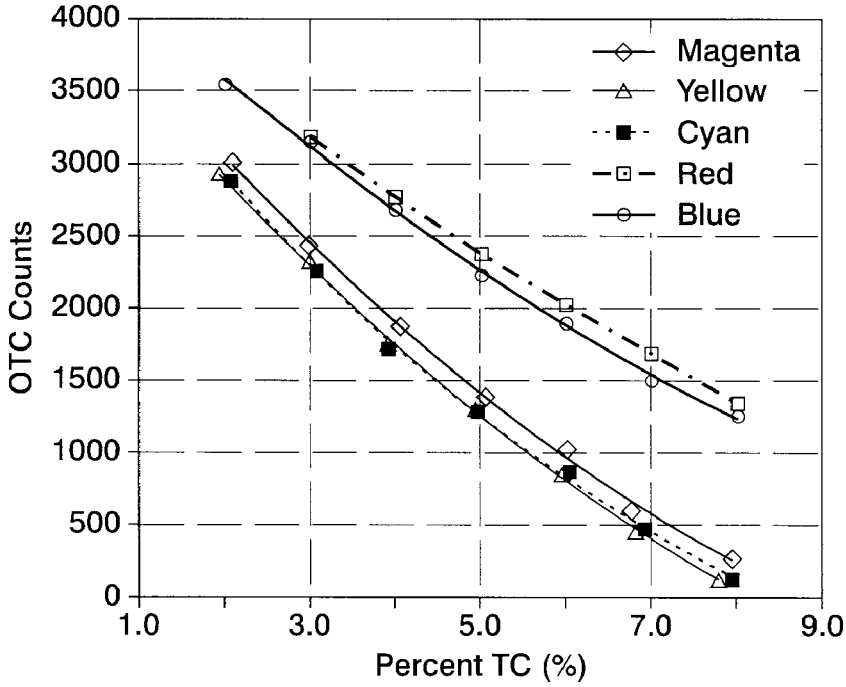
FIG. 4 is a graph that shows exemplary responses of cyan, magenta, yellow, red and blue toner as a function of percent toner concentration (% TC)
Figure 5:
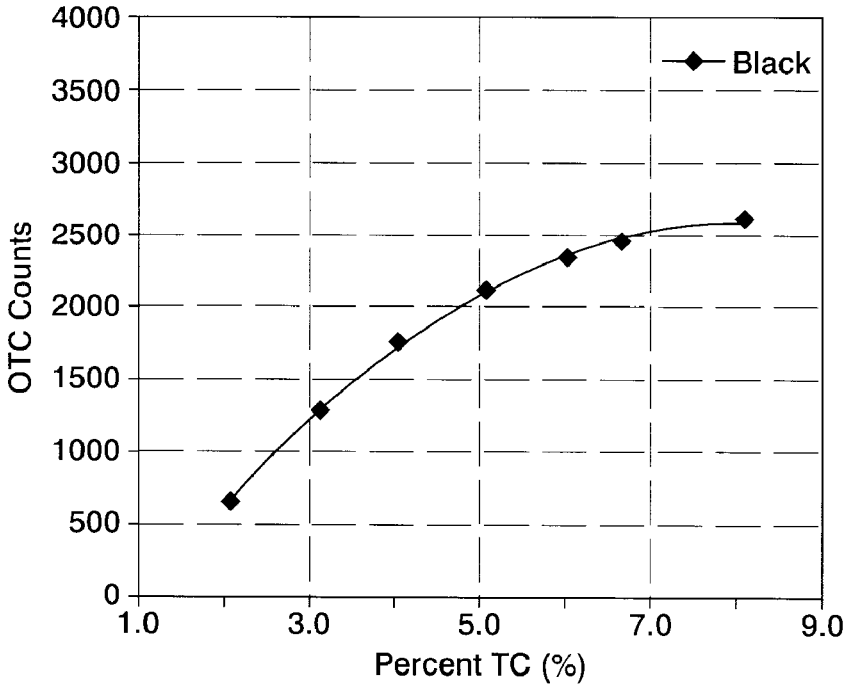
FIG. 5 is a graph that shows an exemplary response of a black toner as a function of % TC.

As described above, the amount of light reflected off the developer material is a function of toner concentration (TC). FIG. 4 is a graph that shows the responses of toners cyan, magenta, yellow, red and blue as a function of percent TC. The graphs in FIGS. 4 and 5 assume that the gains and offset parameters have been adjusted so that the optical toner concentration (OTC) count falls within the range of 350–500 counts/percent TC. For a black developer material, as shown in FIG. 5, the amount of light reflected by the developer material is high when the percent TC is low. Conversely, the amount of light reflected by the developer material is low when the percent TC is high. As discussed above, color developer material including a mixture of carrier and a colored toner reflects light better than the base carrier and cause an increase in the amount of light reflected by the developer material as shown in FIG. 4. As shown in the graph, in the cyan developer material, for example, when the percent TC is approximately 7.0, this may correspond to a count of 500. When the percent TC is approximately 5.0, this may correspond to a count of 1400. This correlation between the percent TC and count at various increment points, for example, percent TC per 10 count increments may be stored as a lookup table in a non-volatile memory, which is subsequently used to determine percent TC in a developer material. Similar correlations may be ascertained for the other color developer materials, that is, magenta, yellow, red, blue and etc., and stored in the non-volatile memory.

FIG. 5 is a graph of a response of the black developer material as a function of percent TC. A black toner, on the other hand, absorbs light and causes the reflected light from the developer mixture to decrease with increasing percent TC. As described with respect to FIG. 4, correlations may be ascertained for the black toner and stored in the non-volatile memory.

Referring back to FIG. 3, a user selection interface (or selector) 401 can be provided on the OTC device 400 so that the user can select the type of the developer material. For advanced users, the user selection interface 401 may provide further calibration features.

Figure 6:
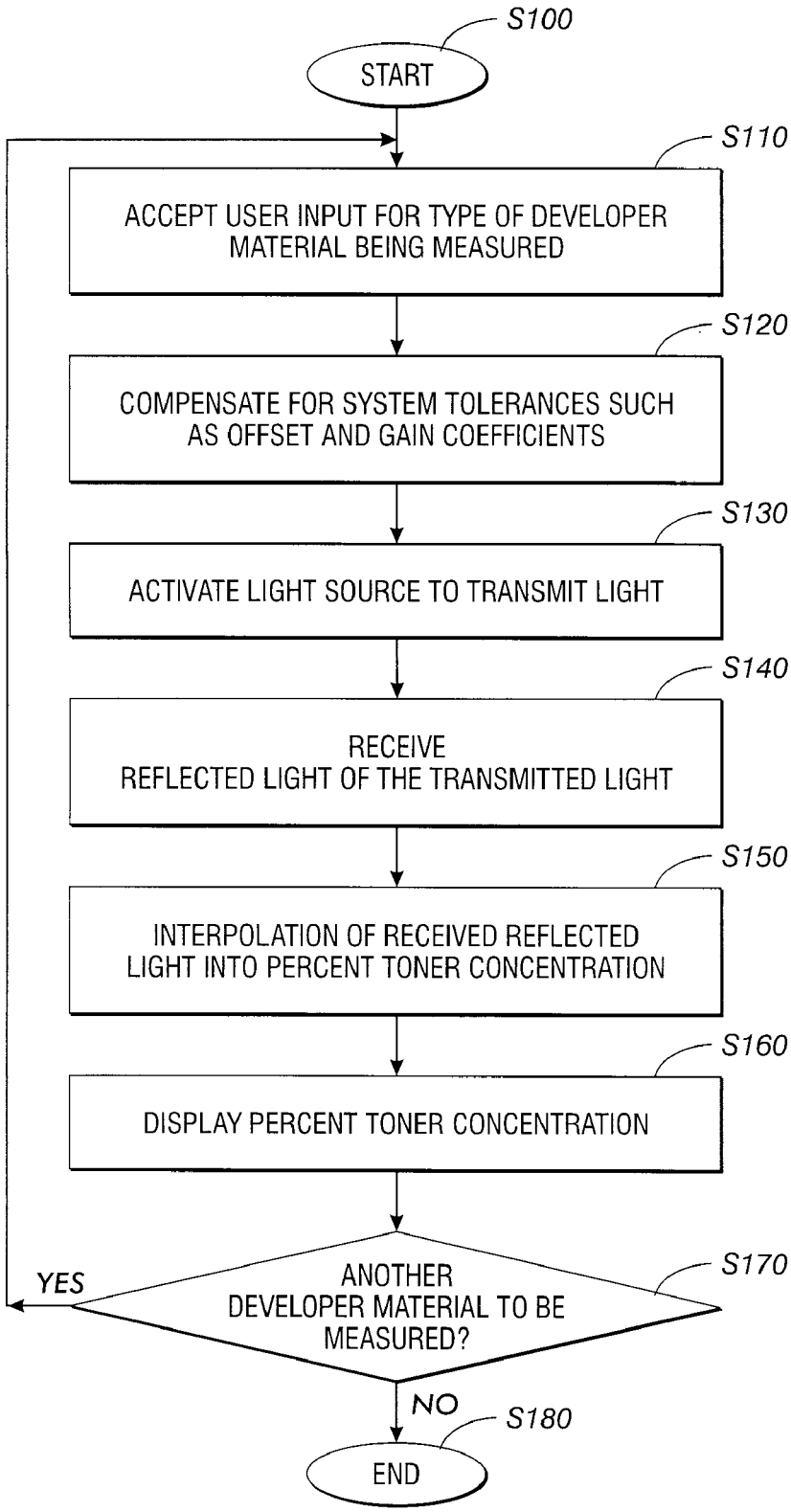
FIG. 6 is a flowchart showing an exemplary operation of measuring toner concentration.

FIG. 6 is a flowchart that illustrates an operation of an exemplary OTC device. The operation starts at step S100 and continues to step S110. At step S110, a developer material type is received. At step S120, depending on the type of developer material, various coefficients, such as gains and offsets are compensated for the selected developer material type. Then, at step S130, a light source is activated to transmit light. The operation then continues to step S140.

At step S140, the reflected light of the transmitted light is received. Then, at step S150, the received reflected light is interpolated to determine a percent toner concentration corresponding to the amount of the received light. At step S160, the percent toner concentration is displayed. At step S170, a determination is made whether another developer material is being measured. If there is another developer material being measured, then the operation continues to step S110 to repeat the process. Otherwise, the operation continues to step S180 where the operation ends.

When performing static or dynamic measurements, the following considerations may be taken to ensure a stable and accurate reading of the toner concentration. In the case of static measurements, a sample is extracted from the developer housing. The sample could be sufficient to result in a 5 mm thick layer in front of the probe. The probe is place in the sample. A selection is made on the type of the developer material. A switch is switched to activate a light source that emits a light to the probe. A waiting period such as 5 seconds is recommended for the readings to stabilize. A toner concentration is then read.

In the case of dynamic measurements, the probe is place in a sample port of the developer housing. A selection is made on the type of the developer material. A switch is switched to activate a light source that emits a light to the probe. A waiting period such as 20 to 60 seconds is recommended for the readings to stabilize. A toner concentration is then read.

In various exemplary embodiments outlined above, the OTC device may be implemented using a programmed microprocessor, a microcontroller, peripheral integrated circuit elements, an application specific integrated circuit (ASIC) or other integrated circuit, a hardwired electronic or logic circuit such as a discrete element circuit, a programmable logic devices such as PLD, PLA, FPGA or PAL, or the like. In general, any device capable of implementing a finite state machine that is in turn capable of implementing the flowchart shown in FIG. 6 may be used to implement the OTC device. Moreover, various selective portions of the OTC device may be implemented as software routines.

While various exemplary embodiments have been described, it is evident that many alternatives, modifications and variations will be apparent to those skilled in the art. Accordingly, the exemplary embodiments, as set forth above, are intended to be illustrative, and not limiting. Various changes may be made.

What is claimed is:

1. A toner concentration measuring device, comprising:

a selector that selects a type of developer material to be measured;

a sensor that detects an amount of light reflected off a developer material;

a controller that determines a value corresponding to a toner concentration of the developer material based on the amount of light detected by the sensor;

a fiber optic bundle assembly that includes at least one emitter fiber, and at least one detector fiber, wherein the emitter fiber is coupled to a light source and the detector fiber is coupled to the sensor; and an enclosure that receives at least a portion of the optic bundle assembly, the enclosure including a transparent window in which the light emitted from the emitter fiber is transmitted through the window and the light received through the window is transmitted to the detector fiber.

2. The toner concentration measuring device of claim 1, further comprising:

a light source that emits light on the developer material.

3. The device of claim 2, wherein the light source emits diffused light.

4. The toner concentration measuring device of claim 1, further comprising:

a memory that stores at least one toner concentration value corresponding to the amount of light received by the sensor, and the controller retrieving the toner concentration value from the memory based on the amount of light received by the sensor.

5. The device of claim 1, wherein the fiber optic bundle assembly including a plurality of emitter fibers and a plurality of detector fibers, wherein the emitter fibers and the detector fibers are randomized so that emitter fibers and the detector fibers are uniformly distributed throughout an end of the fiber bundle assembly.

6. The device of claim 1, wherein the window is oriented at substantially 45 degrees to the fiber optic bundle assembly.

7. The device of claim 1, further comprising an amplifier coupled to the sensor, wherein the amplifier is configured to control a gain of the sensor.

8. The device of claim 1, wherein the device is portable.

9. A method for measuring toner concentration, comprising:

accepting a user input for a type of developer material to be measured;

adjusting gain and/or offset parameters for the type of developer material to be measured;

detecting an amount of reflected light off a developer material; and determining a value corresponding to a toner concentration of the developer material based on the amount of light detected.

10. The method of claim 9, further comprising:

emitting light to the developer material.

11. The method of claim 9, further comprising:

storing at least one toner concentration value corresponding to the amount of received light; and outputting the toner concentration value if a detected light is substantially the amount of light that corresponds to the toner concentration value.

12. A computer readable medium or a modulated signal being encoded to perform the method of claim 11.

13. A computer readable medium or a modulated signal being encoded to perform the method of claim 9.

14. A toner concentration measuring device, comprising:

means for accepting a user input for a type of developer material to be measured;

means for adjusting gain and/or offset parameters for the type of developer material to be measured;

means for detecting an amount of reflected light off a developer material; and means for determining a value corresponding to a toner concentration of the developer material based on the amount of light detected.

15. The toner concentration measuring device of claim 14, further comprising:

means for storing at least one toner concentration value corresponding to the amount of received light.

* * * * *